US008171592B2

(12) United States Patent
Tsai

(10) Patent No.: US 8,171,592 B2
(45) Date of Patent: May 8, 2012

(54) STEAM CLEANER

(76) Inventor: Sam Tsai, JhongHo (TW)

( * ) Notice: Subject to any disclaimer, the term of this patent is extended or adjusted under 35 U.S.C. 154(b) by 917 days.

(21) Appl. No.: 12/203,449

(22) Filed: Sep. 3, 2008

(65) Prior Publication Data

US 2010/0050367 A1 Mar. 4, 2010

(51) Int. Cl.
*A47L 11/16* (2006.01)
*G11B 23/50* (2006.01)

(52) U.S. Cl. ..... 15/98; 15/320; 15/403

(58) Field of Classification Search ..... 15/320, 15/403, 97.1, 98; *A47L 11/16; G11B 23/50*
See application file for complete search history.

(56) References Cited

U.S. PATENT DOCUMENTS

| | | | | |
|---|---|---|---|---|
| 7,380,307 | B2 * | 6/2008 | Tsai | 15/320 |
| 7,930,798 | B2 * | 4/2011 | Zhou et al. | 15/320 |
| 2004/0031506 | A1 * | 2/2004 | Tsai | 134/105 |
| 2004/0134016 | A1 * | 7/2004 | Kisela et al. | 15/320 |

* cited by examiner

*Primary Examiner* — David Redding
(74) *Attorney, Agent, or Firm* — Rabin & Berdo, P.C.

(57) ABSTRACT

The present invention relates to a steam cleaner that is lightweight and is prepared for operation quickly and easily and comprises handle assembly, a pivoting connector, a reservoir, a reservoir socket, a steam head and an electric wire. The handle assembly comprises a grip and a lever. The pole connector is attached to the steam head. The reservoir is mounted detachably in the reservoir socket and is easily removed to fill the reservoir with tap water. Squeezing the handle assembly releases water from the reservoir into the steam head where steam is generated to clean a floor.

9 Claims, 7 Drawing Sheets

STEAM CLEANER

FIELD OF THE INVENTION

The invention relates to a steam cleaner, particularly to a steam cleaner that operates easily and generates steam stability.

BACKGROUND OF THE INVENTION

Conventional floor steam cleaners comprise a steam head, a steam generator and an integral reservoir. Water from the reservoir flows thought the steam generator and is heated to form steam. Steam is useful in removing oil and sticky matter from a floor. Several methods exist to make the water flow into the reservoir. One method uses a valve to control the water inlet. When the valve is open, gravity causes water to flow into the reservoir. Another method uses a pump to control the flow of water. The above methods have drawbacks such as difficult operation, complex mechanical structure or unstable steam generation.

SUMMARY OF THE INVENTION

The primary objective of the present invention is to provide a portable floor steam cleaner that is light-weight and is prepared for operation quickly and easily.

The steam cleaner comprises a handle assembly, a pole connector, a reservoir, a reservoir socket, a steam head and an electric wire. The handle assembly comprises a grip and a lever. The pivoting connector is attached to the steam head. The reservoir is mounted detachably in the reservoir socket and is removed easily to fill the reservoir with tap water. Squeezing the handle assembly releases water from the reservoir into the steam head where steam needs to be generated to clean a floor.

DESCRIPTION OF THE PREFERRED EMBODIMENT

Figure 1:
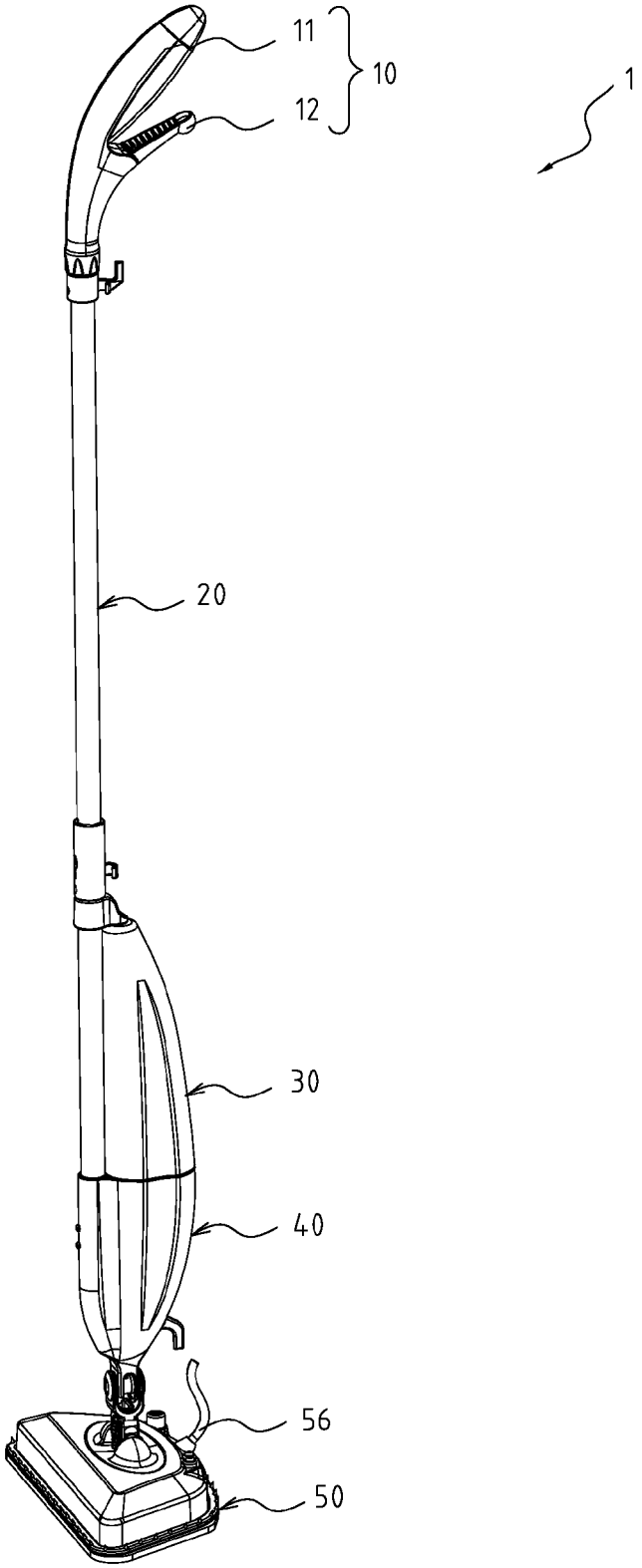
FIG. 1 is a perspective view of a floor steam cleaner in accordance with the present invention.

With reference to FIG. 1, a floor steam cleaner (1) in accordance with the present invention is portable and light-weight, is prepared for operation quickly and easily and comprises a steam head (50), a reservoir socket (40), a reservoir (30), a pole connector (20) and a handle assembly (10).

Figure 2:
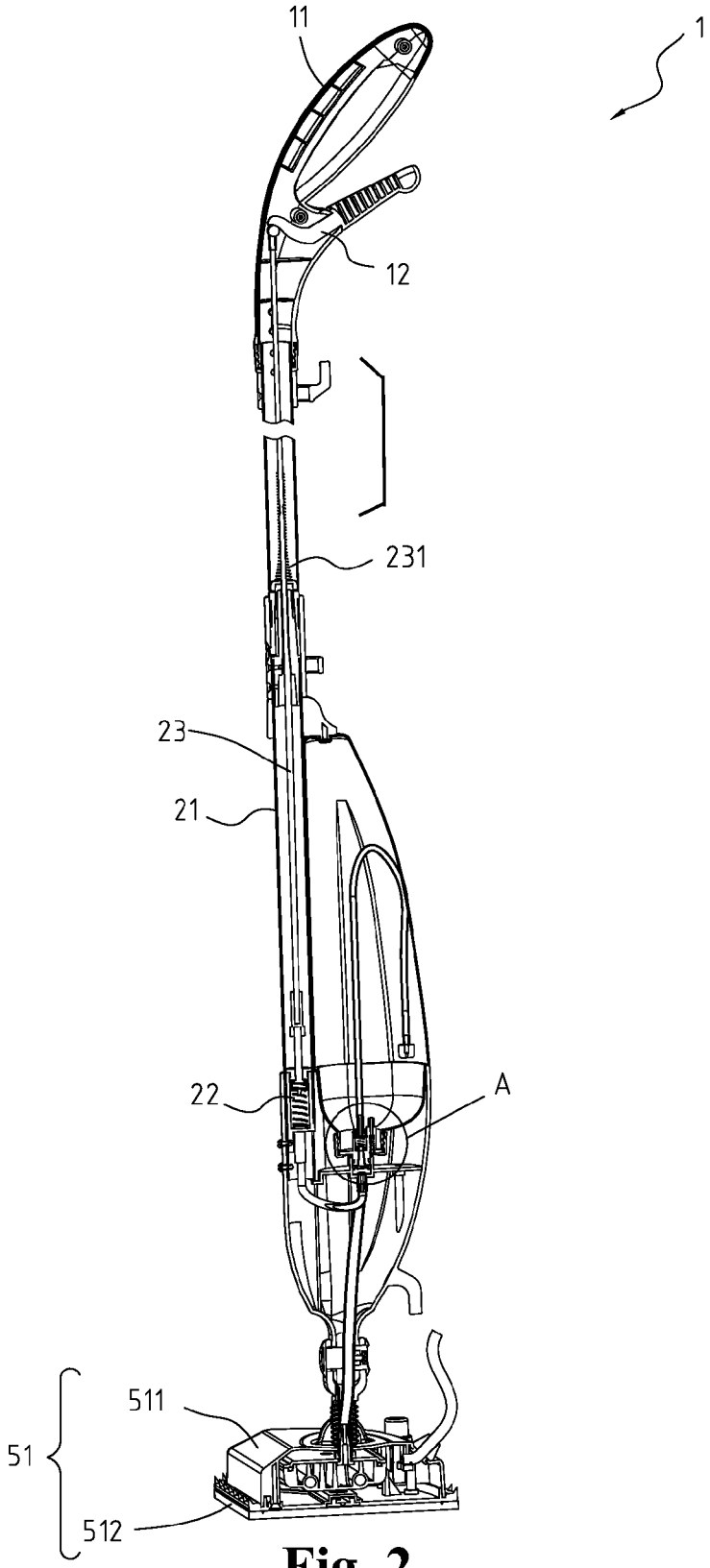
FIG. 2 is a side view in partial section of the floor steam cleaner in FIG. 1.
Figure 6:
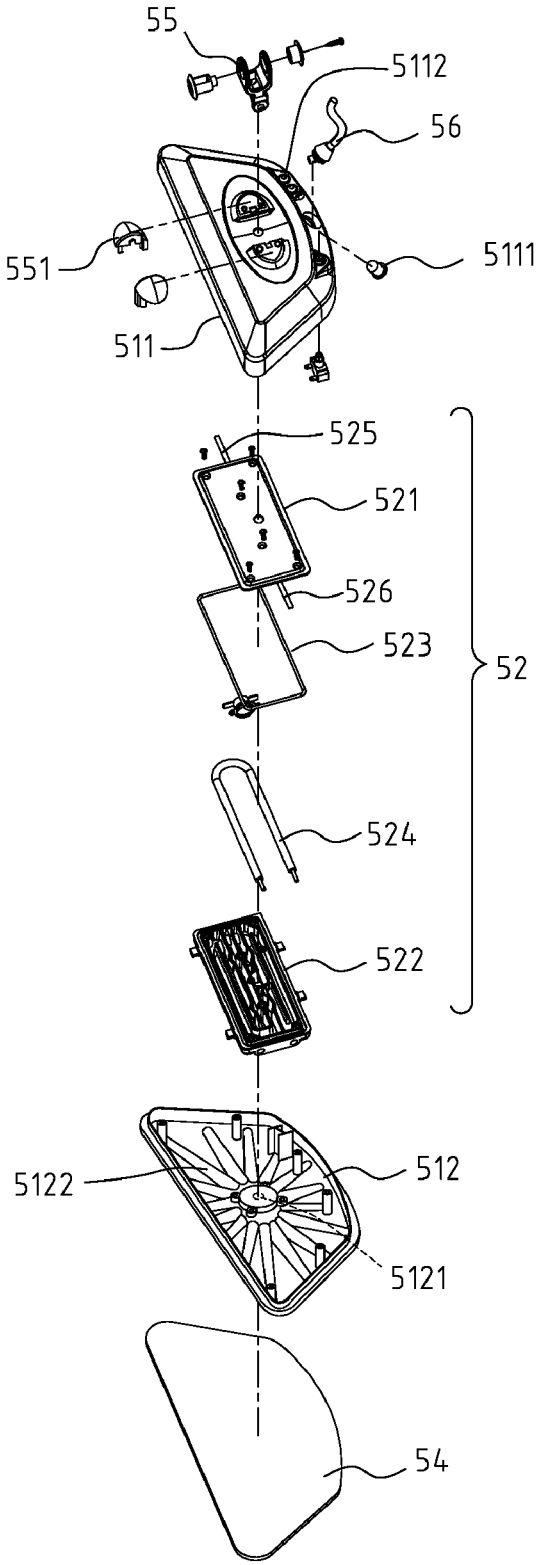
FIG. 6 is a first embodiment of a steam head of the floor steam cleaner in FIG. 1.
Figure 7:
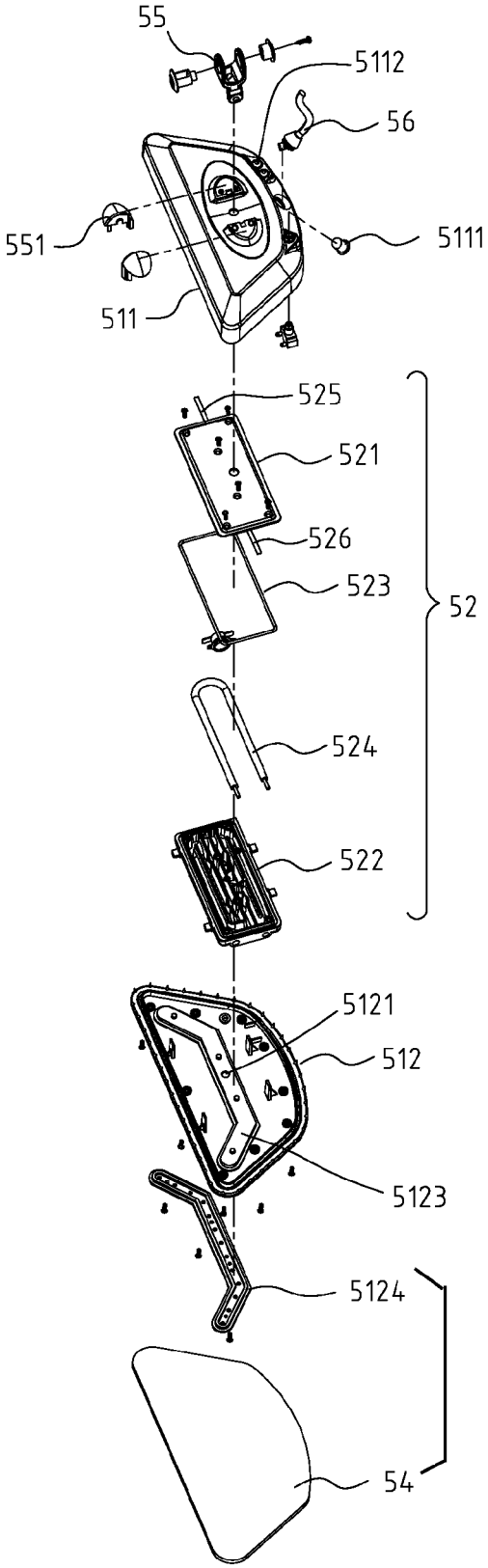
FIG. 7 is a second embodiment of a steam head of the floor steam cleaner in FIG. 2.

With further reference to FIGS. 2, 6 and 7, the steam head (50) converts water to steam, sprays steam against a floor surface, has a hollow chamber (51), a steamer (52), a cleaning cover (54), a stationary connector (55) and an electric wire (56). The hollow chamber (51) comprises a top surface (511), a bottom surface (512). The top surface (511) has a center, a bulb (5111), an on/off switch (5112) and an opening. The on/off switch (5112) is connected to the electric wire (56) to activate and deactivate the steamer (52). The opening is formed near the center of the top surface (511). The bottom surface (512) has a center, an outer edge, an inner cavity, a steam port (5121), at least one groove (5122, 5123), an optional groove cover (5124), a flange. The steam port (5121) is formed through the center of the bottom surface (512). The at least one groove (5122, 5123) is formed in the bottom surface (512), communicates with the steam port (5121) and may be multiple radial grooves (5122) or a single transverse groove (5123). The groove cover (5124) covers the single transverse groove (5123) and has multiple steam ports formed along the groove cover (5124). The flange is formed on and protrudes radically out from the outer edge of the steam head (50).

The steamer (52) converts water to steam, sprays steam against a floor surface and has an upper surface (521), a lower surface (522), a seal ring (523), a heater (524), a water inlet (525) and a steam outlet (526). The water inlet (525) is formed between the upper surface (521) and the lower surface (522). The steam outlet (526) is connected to the steam port (5121) of the steam head (50), so steam formed in the steamer (52) will be forced out of the steam outlet and the steam port (5121) and into the at least one groove (5122, 5123).

The electric wire (56) is connected to the steamer (52) to provide electricity to heat water and generate steam and detachably connects to an electrical outlet.

The cleaning cover (54) is used to clean smooth floors, is elastic material such as terrycloth or a scrubbing pad, is mounted on the flange of the steam head (50) and covers the bottom surface (512) of the steam head (50).

With further reference to FIGS. 2 to 7, the reservoir socket (40) is connected pivotally to the stationary connector (55) on the steam head (50) and has a lower end, and an upper end.

The reservoir socket (40) has an open top and a lid (41). The lid (41) has a hole (411) (see FIG. 3) and a thrusting rod (42). The thrusting rod (42) is coaxial with the hole (411).

The reservoir (30) holds water, is detachably mounted securely in the reservoir socket (40), is easily removed and filled with tap water and has a closed top, an open bottom, an outer surface, a cap (31) and a reservoir fastener (32).

Figure 3:
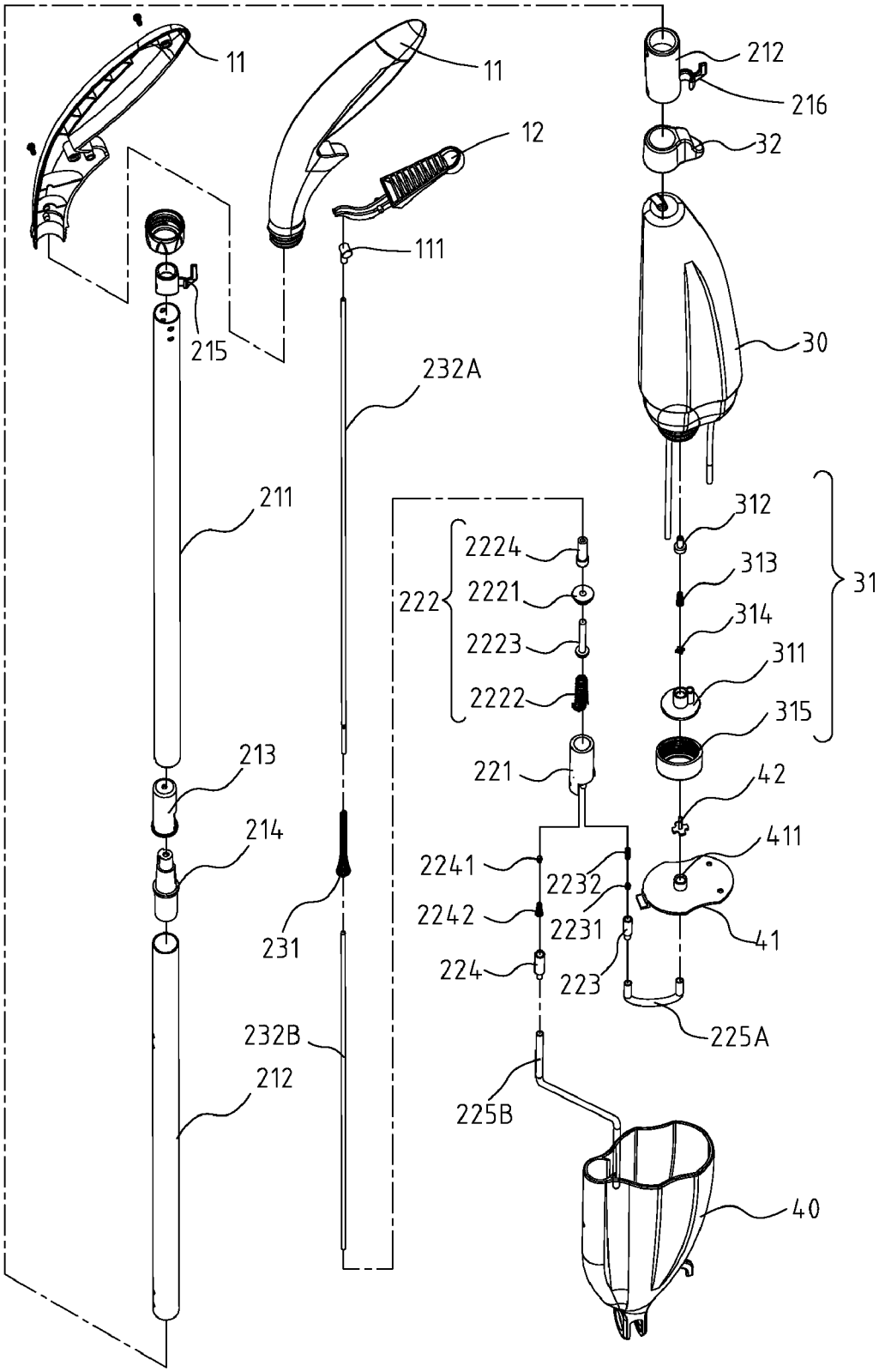
FIG. 3 is an exploded perspective view of a pole connector, a reservoir and a handle assembly of the floor steam cleaner in FIG. 1.
Figure 4:
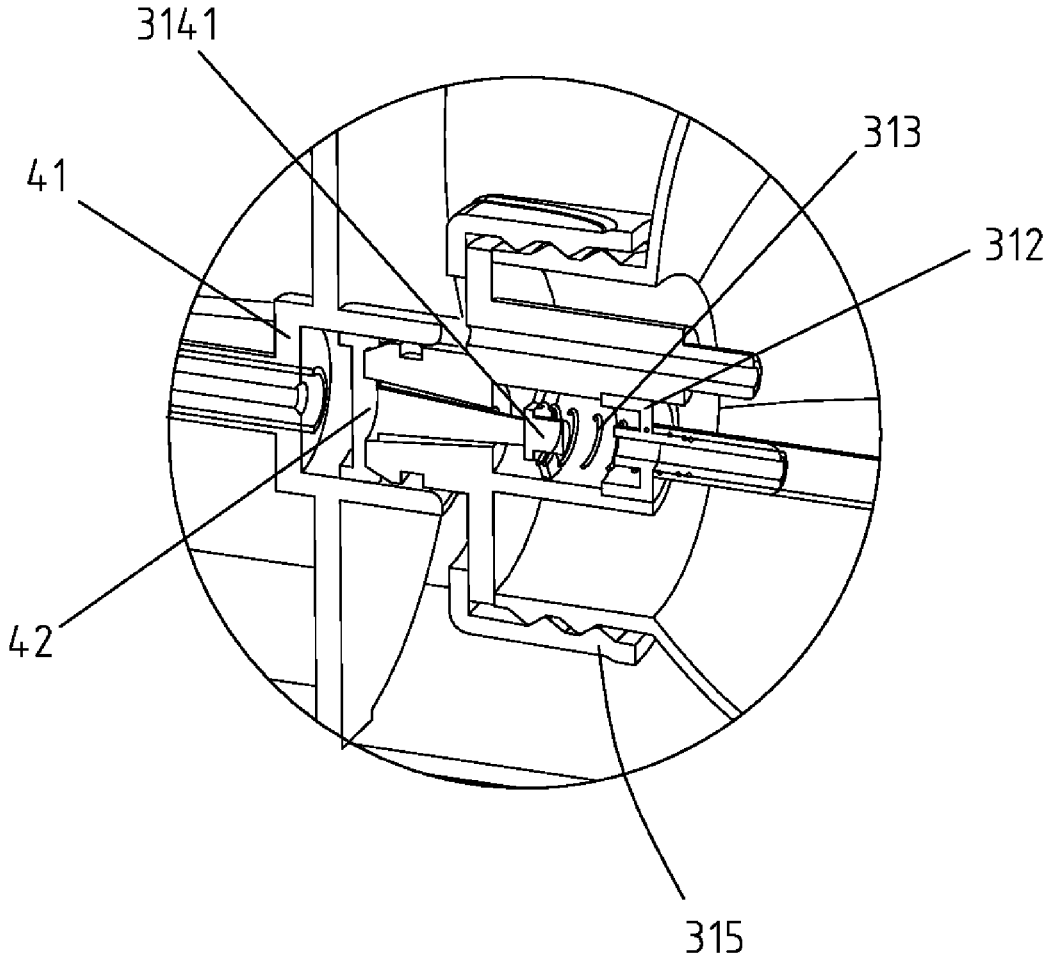
FIG. 4 is an enlarged cross sectional perspective view of the reservoir and a cap on the reservoir in FIG. 3.

As best shown in FIG. 3, the cap (31) covers and selectively closes the reservoir (30), is removed to fill the reservoir (30) with tap water and has an opening and comprises a reservoir cap (311), a water outlet cap (312), a piston-reset spring (313), a water valve (314), an O-ring (3141), and a threaded ring (315). The threaded ring (315) is mounted on the open bottom of the reservoir (30). The reservoir cap (311), the water outlet cap (312), the piston-reset spring (313), the water valve (314) are mounted inside the threaded ring (315), keeps water from leaking from the reservoir (30) before the reservoir (30) is seated in the reservoir socket (40). The reservoir cap (311) has a hole for the thrusting rod (42) passes through. The water outlet cap (312) is mounted inside of the reservoir cap (311) and pushed up by the thrusting rod (42) for water flowing out. The O-ring (3141) is mounted around the water valve (314) and seals the reservoir (30) when the reservoir (30) is fully seated in the reservoir socket (40).

Figure 5:
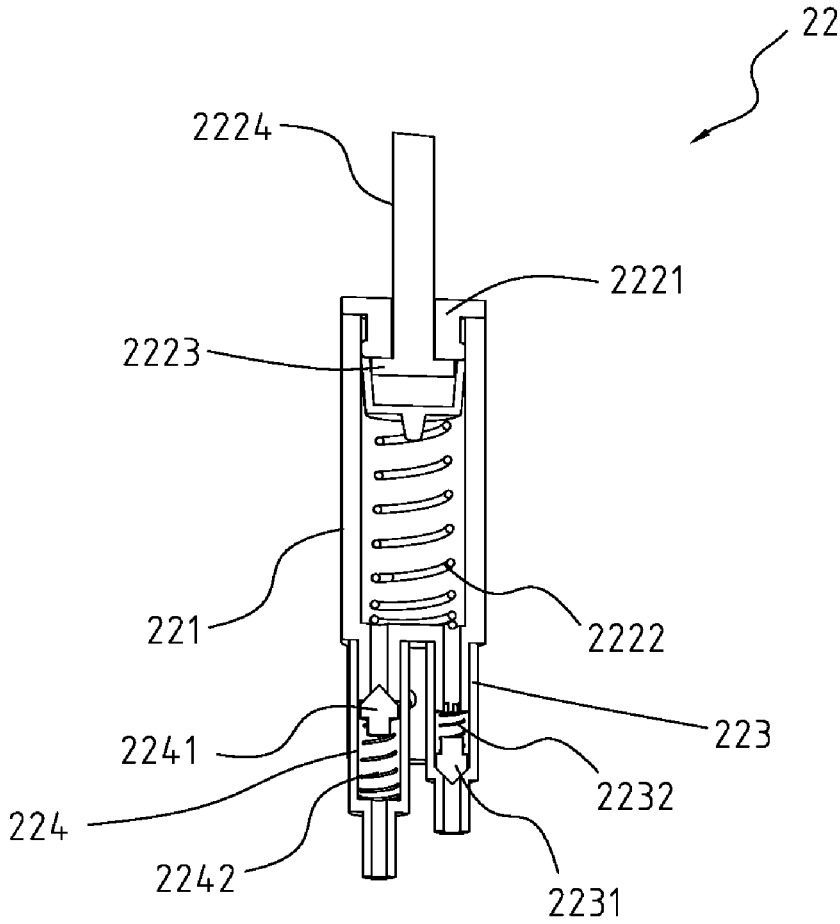
FIG. 5 is a side view in partial section of an actuator of a pole connector of the floor steam cleaner in FIG. 2.

With reference to FIGS. 2 to 3 and FIG. 5, the pole connector (20) comprises a hollow pole (21), a piston pump (22) and an actuating rod (23). The hollow pole (21) is material of aluminum and comprises an upper pole (211) and a lower pole (212). The upper pole (211) has two ends. One end of the upper pole (211) connects to the grip (11) and has an upper wire hook (215) at the opening of the upper pole (211) for wrapping the electric wire (56). The other end has an upper connector (213). The lower pole (212) also has two ends. One end of the lower pole (212) connects to the reservoir (30) and has a lower wire hook (216) at the opening of the lower pole (212) for wrapping the electric wire (56). The other end has a lower connector (214) that connects to the upper connector (213) to assemble the upper pole (211) and the lower pole (212).

The piston pump (22) is mounted in the lower pole (212) and comprises a cylinder (221), a pumping unit (222), a water inlet (223) and a water outlet (224). The cylinder (221) has a top opening and a bottom opening. The pumping unit (222) is mounted in the cylinder (221) and comprises a pump cap (2221), a spring (2222), a piston (2223) and a cylinder sleeve (2224).

The pump cap (2221) covers the top opening of the cylinder (221) has a pore in the central of the pump cap (2221). The spring (2222) is mounted in the cylinder (221). The piston (2223) is mounted movably in the cylinder (221) against the top of the spring (2222), and has a rod. The rod passes through the pore of the pump cap (2221) and couples with the cylinder sleeve (2224).

The water inlet (223) comprises a water inlet piston (2231) and a water inlet spring (2232) and has two ends. One end is connected to the cylinder (221) in the opposite opening of the pump cap (2221). The other end is connected to the reservoir socket (40) by a water inlet tube (225A). The water inlet piston (2231) is closed by pressing the piston (2223) and opened by pushing the piston (2223) back through the spring (2222) for water flowing into the cylinder (221).

The water outlet (224) is parallel to the water inlet (223), comprises a water outlet piston (2241) and a water outlet spring (2242) and has two ends. One end is connected to cylinder (221) in the opposite opening of the pump cap (2221). The water outlet piston (2241) is opened by pressing the piston (2223) for water flowing out.

The actuating rod (23) is mounted in the hollow pole (21) and connects to the cylinder sleeve (2224), is material of iron or steel, and comprises a compression spring (231), an actuating rod A (232A) and an actuating rod B (232B).

The compression spring (231) is mounted in the hollow pole (21) and connects with the actuating rod A (232A) and the actuating rod B (232B). The actuating rod A (232A) is mounted in the upper pole (211) and connects to the handle assembly (10). The actuating rod B (232B) is mounted in the lower pole (212) and connects to the cylinder sleeve (2224) of the piston pump (22).

The flexible tube is mounted through the longitudinal hole in the pivoting joint and connects the coaxial hole in the reservoir socket to the water inlet of the steamer (52).

The handle assembly (10) is mounted on the upper end of the pole connector (20) and comprises a grip (11) and a lever (12). The grip (11) is hollow, has an open lower end and a lever opening. The lever opening is formed near the open lower end. The lever (12) extends into and is attached pivotally to the grip (11) and has an inner end. The inner end is aligned with a segmented pole (111) and attaches to the actuating rod (23) (see FIGS. 2 and 3).

Squeezing the lever (12) presses the piston into the cylinder (221) to release from the reservoir (30) and flows into the steam head (50).

What is claimed is:

1. A steam cleaner, comprising:

a steam head having a hollow chamber comprising a top surface and a bottom surface, the bottom surface having at least one groove;

a steamer mounted in the hollow chamber;

a cleaning cover covering the bottom surface of the steam head;

a stationary connector; and an electric wire;

a reservoir socket connected pivotally to the stationary connector on the steam head and having an open top;

a lid having a hole and a thrusting rod, the thrusting rod being coaxial with the hole; and a reservoir that holds water, being detachably mounted securely in the reservoir socket and having a closed top, an open bottom, an outer surface, a cap and a reservoir fastener;

a pole connector connecting to a handle assembly and comprising a hollow pole, connecting to a lower portion of the handle assembly and having an upper pole and a lower pole;

a piston pump mounted in the lower pole of the hollow pole; and an actuating rod mounted in the hollow pole and comprising an actuating rod A, connecting to the handle assembly;

an actuating rod B, connecting to the piston pump; and a compression spring, connecting the actuating rod A with the actuating rod B; and the handle assembly, comprising a grip including two plastic shells with an upper portion and a lower portion; and a lever extending into and being attached pivotally to the grip and having an inner end, the inner end being aligned with a segmented pole and attaching to the actuating rod.

2. The steam cleaner as claimed as claim 1, wherein the upper pole has two ends, one end of the upper pole connects to the grip and has an upper wire hook at an opening of the upper pole, and the other end has an upper connector; and the lower pole also has two ends, one end of the lower pole connects to the reservoir and has a lower wire hook at an opening of the lower pole, the other end has a lower connector that connects to the upper connector to assemble the upper pole and the lower pole.

3. The steam cleaner as claimed as claim 2, wherein the steamer is mounted in the hollow chamber and comprises an upper surface;

a lower surface;

a seal ring sealing the upper surface and the lower surface;

a heater mounted between the upper surface and the lower surface;

a water inlet formed between the upper surface and the lower surface; and a steam outlet connected to the steam head.

4. The steam cleaner as claimed as claim 3, wherein the piston pump is mounted in the lower pole, connects to the reservoir and comprises a cylinder having a top opening and a bottom opening;

a pumping unit, comprising a pump cap mounted on one opening of the cylinder and having a pore in a center of the pump cap;

a spring mounted in the cylinder; and a piston having two sides, one side being attached to the spring, and the other side being connected to a rod that passes through the pore of the pump cap and couples with a cylinder sleeve; and a water inlet having two ends, one end being connected to the cylinder in the opening opposite to the pump cap, the other end is connected to the reservoir socket by a water inlet tube and comprises a water inlet piston that is closed by pressing the piston and opened by pushing the piston back through the spring for water flowing into the cylinder; and a water inlet spring; and a water outlet that is parallel to the water inlet, and that has two ends, one end being connected to the cylinder in the opening opposite to the pump cap, and comprises a water outlet piston that is opened by pressing the piston for water flowing out; and a water outlet spring.

5. The steam cleaner as claimed as claim 1, wherein the reservoir comprises a reservoir cap having a hole for the thrusting rod to pass through;

a water outlet cap mounted inside of the reservoir cap and pushed up by the thrusting rod for water flowing out;

a piston-reset spring;

a water valve having an O-ring mounted around the water valve; and a threaded ring mounted on an open bottom of the reservoir.

6. The steam cleaner as claimed as claim 5, wherein the actuating rod is comprised of iron.

7. The steam cleaner as claimed as claim 5, wherein the actuating rod is comprised of steel.

8. The steam cleaner as claimed as claim 5, wherein the at least one groove of the steam head is a single transverse groove.

9. The steam cleaner as claimed as claim 5, wherein the at least one groove of the steam head are multiple radial grooves.

* * * * *